US010201970B2

(12) United States Patent
Goto et al.

(10) Patent No.: US 10,201,970 B2
(45) Date of Patent: Feb. 12, 2019

(54) LIQUID EJECTION HEAD, LIQUID EJECTION APPARATUS, AND CONTROL METHOD

(71) Applicant: CANON KABUSHIKI KAISHA, Tokyo (JP)

(72) Inventors: Akio Goto, Tokyo (JP); Yoshinori Misumi, Tokyo (JP); Maki Kato, Fuchu (JP); Norihiro Yoshinari, Kawasaki (JP); Yuzuru Ishida, Yokohama (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/793,217

(22) Filed: Oct. 25, 2017

(65) Prior Publication Data

US 2018/0141335 A1 May 24, 2018

(30) Foreign Application Priority Data

Nov. 18, 2016 (JP) ..... 2016-225312

(51) Int. Cl.
*B41J 2/06* (2006.01)
*B41J 2/085* (2006.01)
(Continued)

(52) U.S. Cl.
CPC ..... *B41J 2/06* (2013.01); *B41J 2/085* (2013.01); *B41J 2/1404* (2013.01);
(Continued)

(58) Field of Classification Search
CPC ..... B41J 2/06; B41J 2/035; B41J 2/085; B41J 2/1404; B41J 2/14064; B41J 2/14129;
(Continued)

(56) References Cited

U.S. PATENT DOCUMENTS 6,109,734 A 8/2000 Kashino et al.
6,113,223 A 9/2000 Tanaka et al.
(Continued)

FOREIGN PATENT DOCUMENTS

JP 2009-051146 A 3/2009

*Primary Examiner* — Juanita D Jackson
(74) *Attorney, Agent, or Firm* — Venable, LLP

(57) ABSTRACT

The liquid ejection head includes a wall member having formed therein a void for communicating between a first liquid chamber and a second liquid chamber; a first energy generation element to eject the liquid in the first liquid chamber; a second energy generation element to eject the liquid in the second liquid chamber; a first electrode arranged in a vicinity of the first energy generation element in the first liquid chamber; a second electrode for forming, between the first electrode and the second electrode, an electric field in liquid inside the first liquid chamber; and a supply port which supplies liquid to the first energy generation element. The wall member includes a channel wall defining a channel through which the second liquid chamber, the void, and the supply port communicate, and the second electrode is arranged between the second liquid chamber and the supply port in the channel.

18 Claims, 9 Drawing Sheets

(51) Int. Cl.
*B41J 2/14* (2006.01)
*B41J 2/175* (2006.01)
*B41J 29/38* (2006.01)

(52) U.S. Cl.
CPC ..... *B41J 2/14064* (2013.01); *B41J 2/14129* (2013.01); *B41J 2/1753* (2013.01); *B41J 2/17553* (2013.01); *B41J 29/38* (2013.01); *B41J 2002/061* (2013.01); *B41J 2002/14475* (2013.01); *B41J 2202/18* (2013.01)

(58) Field of Classification Search
CPC .. B41J 2/1753; B41J 2/17553; B41J 2/14088; B41J 2/14032; B41J 2/14072; B41J 2/14016; B41J 2/14056; B41J 2/16517; B41J 2002/061; B41J 2002/062; B41J 29/38
See application file for complete search history.

(56) References Cited

U.S. PATENT DOCUMENTS 6,244,693 B1 6/2001 Misumi
6,252,616 B1 6/2001 Okazaki et al.
6,491,382 B2 12/2002 Taneya et al.
6,663,229 B2 12/2003 Komuro et al.
6,761,434 B2 7/2004 Ishinaga et al.
6,971,171 B2 12/2005 Komuro et al.
8,210,654 B2 * 7/2012 Wei ..... B41J 2/14016 347/55
9,682,552 B2 6/2017 Kato et al.

* cited by examiner

LIQUID EJECTION HEAD, LIQUID EJECTION APPARATUS, AND CONTROL METHOD

BACKGROUND OF THE INVENTION

Field of the Invention

The present invention relates to a liquid ejection head, a liquid ejection apparatus, and a control method. Particularly, the present invention relates to a technique for keeping, away from the heater, a component contained in ink and capable of becoming a hardly-soluble substance to thereby reduce a "koge" (meaning "scorch") adhering to a heater, by forming an electric field in the ink to be ejected by heating the heater.

Description of the Related Art

In a liquid ejection head which ejects liquid by foaming the liquid with heat generated by a heater, there is known a phenomenon in which a charged colloidal particle or the like contained in the liquid is decomposed by being exposed to high-temperature heating, changes into a hardly-soluble substance, and adheres to the surface of a heating element. This phenomenon is referred to as "kogation" (meaning "scorching") and an adhesive material is referred to as a "koge." Once a koge adheres to the surface of a heating element, there are cases where the heat conduction to ink may become nonuniform and foaming may become unstable.

In order to solve the problems as described above, Japanese Patent Laid-Open No. 2009-51146 describes that a heater upper electrode arranged in a vicinity of a heater as a heating element and an electrode paired with this heater upper electrode form an electric field in ink between these electrodes. Then, this formed electric field keeps a charged colloidal particle in the ink away from the heater upper electrode to thereby reduce the concentration of the charged colloidal particles in a vicinity of the heater, and suppresses the adhesion of a koge to the surface of the heater.

However, in Japanese Patent Laid-Open No. 2009-51146, depending on the arrangement of a paired electrode, there are cases where a vicinity thereof may cause stagnation in the flow of ink. Then, relatively minute bubbles present in the ink may gather in this stagnated portion to thereby become a large bubble and stay. As described above, in a case where a bubble stays in a vicinity of a paired electrode, the resistance between the heater upper electrode and the paired electrode increases since the electric conductivity of the bubble is relatively lower than that of the liquid. As the result, the amount of charged colloidal particles which move to the side of the paired electrode by the generated electric field may decrease, and thus an effect of suppressing kogation may become insufficient.

SUMMARY OF THE INVENTION

The present invention provides, in a configuration for suppressing the adhesion of a koge onto the surface of a heater by forming an electric field between an electrode in a vicinity of the heater and a paired electrode, a liquid ejection head, a liquid ejection apparatus, and a control method capable of reducing the staying of a bubble in a vicinity of the paired electrode.

In the first aspect of the present invention, there is provided a liquid ejection head comprising: a wall member for partitioning a first liquid chamber and a second liquid chamber adjacent to each other and forming the first liquid chamber and the second liquid chamber, the wall member having formed therein a void for communicating between the first liquid chamber and the second liquid chamber; a first energy generation element which is provided in the first liquid chamber and foams liquid in order to eject the liquid; a second energy generation element which is provided in the second liquid chamber and foams liquid in order to eject the liquid; a first electrode which is provided in the first liquid chamber and is arranged in a vicinity of the first energy generation element; a second electrode for forming, between the first electrode and the second electrode, an electric field in liquid inside the first liquid chamber; and a supply port which supplies liquid to the first energy generation element, wherein the wall member includes a channel wall in which the second liquid chamber, the void, and the supply port communicate, in this order, with each other via liquid, and the second electrode is arranged between the second liquid chamber and the supply port in the channel.

In the second aspect of the present invention, there is provided a liquid ejection apparatus comprising: a liquid ejection head including: a wall member for partitioning a first liquid chamber and a second liquid chamber adjacent to each other and forming the first liquid chamber and the second liquid chamber, the wall member having formed therein a void for communicating between the first liquid chamber and the second liquid chamber; a first energy generation element which is provided in the first liquid chamber and foams liquid in order to eject the liquid; a second energy generation element which is provided in the second liquid chamber and foams liquid in order to eject the liquid; a first electrode which is provided in the first liquid chamber and is arranged in a vicinity of the first energy generation element; a second electrode which is provided in the first liquid chamber and is for forming, between the first electrode and the second electrode, an electric field in liquid inside the first liquid chamber; and a supply port which supplies liquid to the first energy generation element, wherein the wall member includes a channel wall in which the second liquid chamber, the void, and the supply port communicate, in this order, with each other via liquid, and the second electrode is arranged between the second liquid chamber and the supply port in the channel; a detection unit configured to detect a bubble between the first electrode and the second electrode in the first liquid chamber; and a generation unit configured to generate, in a case where the detection unit detects a bubble, a flow of liquid moving toward the first liquid chamber via the void from the second liquid chamber.

In the third aspect of the present invention, there is provided a control method of a liquid ejection head, the liquid ejection head including: a wall member for partitioning a first liquid chamber and a second liquid chamber adjacent to each other and forming the first liquid chamber and the second liquid chamber, the wall member having formed therein a void for communicating between the first liquid chamber and the second liquid chamber; a first energy generation element which is provided in the first liquid chamber and foams liquid in order to eject the liquid; a second energy generation element which is provided in the second liquid chamber and foams liquid in order to eject the liquid; a first electrode which is provided in the first liquid chamber and is arranged in a vicinity of the first energy generation element; a second electrode for forming, between the first electrode and the second electrode, an electric field in liquid inside the first liquid chamber; and a supply port which supplies liquid to the first energy generation element, wherein the wall member includes a channel wall in which the second liquid chamber, the void, and the supply port communicate, in this order, with each other via liquid, and the second electrode is arranged between the second liquid chamber and the supply port in the channel, the method comprising the step of generating a flow of liquid which moves toward the supply port through the second electrode via the void from the second liquid chamber.

According to the above-described configuration, in the configuration for suppressing the adhesion of a koge onto the surface of a heater by forming an electric field between the electrode in a vicinity of the heater and the paired electrode, it becomes possible for a liquid ejection head to reduce the staying of a bubble in a vicinity of the paired electrode.

Further features of the present invention will become apparent from the following description of exemplary embodiments with reference to the attached drawings.

DESCRIPTION OF THE EMBODIMENTS

Hereinafter, the embodiments of the present invention will be described in detail with reference to the drawings.

Figure 1:
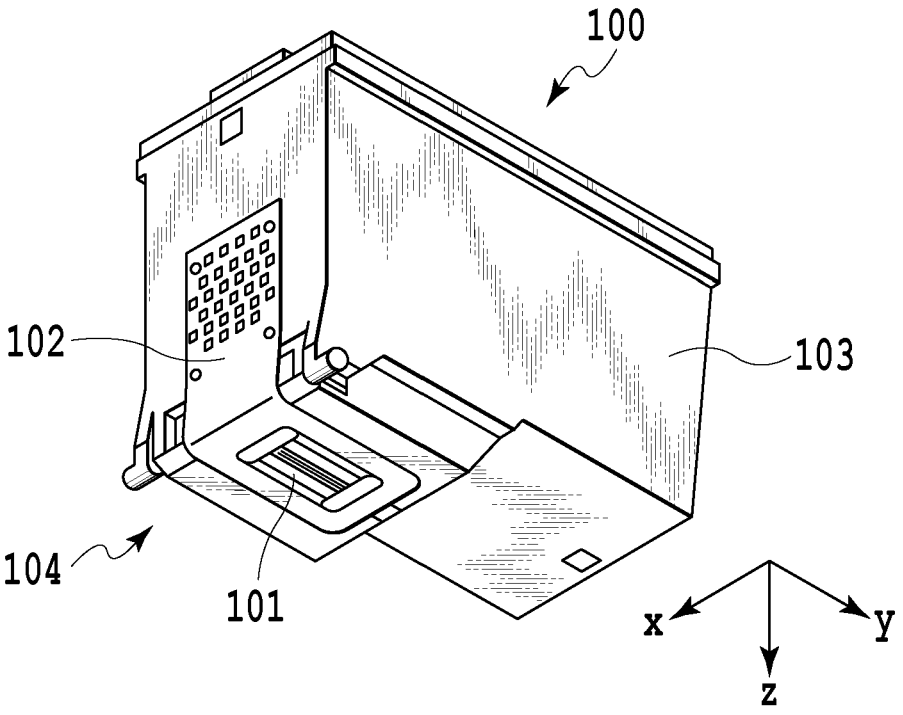
FIG. 1 is a perspective view illustrating a liquid ejection head according to an embodiment of the present invention.

FIG. 1 is a perspective view illustrating a liquid ejection head according to an embodiment of the present invention. A liquid ejection head 104 of this embodiment has the form of a head cartridge 100 integrally constituted with an ink container 103 storing ink as liquid. Note that, here, although there will be explained a form in which a liquid ejection head and an ink container are integrally constituted, the ink container may be detachable from the liquid ejection head.

As illustrated in FIG. 1, the liquid ejection head 104 includes: a printing-element substrate 101 as the substrate for a liquid ejection head; and an electric wiring member 102. As explained later in FIG. 3A, FIG. 3B, and the like, a plurality of electrothermal conversion elements (heaters) as an energy generation element for ejecting ink and an electric wiring which supplies power to an electrothermal conversion element 10 are formed on one of the surfaces of the printing-element substrate 101. An ejection port forming member (liquid chamber-forming member) which forms a plurality of ejection ports is formed on this printing-element substrate 101. Furthermore, on the printing-element substrate 101, an ink supply port for supplying ink to a channel formed for each electrothermal conversion element is formed extending through the substrate. The electric wiring member 102 includes: an opening for incorporating the printing-element substrate 101; and an inner lead corresponding to an electrical connection portion connected to an electric wiring formed on the printing-element substrate 101. The inner leads are formed extending inside the openings, and are formed in parallel in a predetermined direction. Moreover, the electric wiring member 102 also includes an input terminal for receiving a drive control signal from a non-illustrated printing apparatus (liquid ejection apparatus) by connecting to an electric contact of the printing apparatus.

Figure 2:
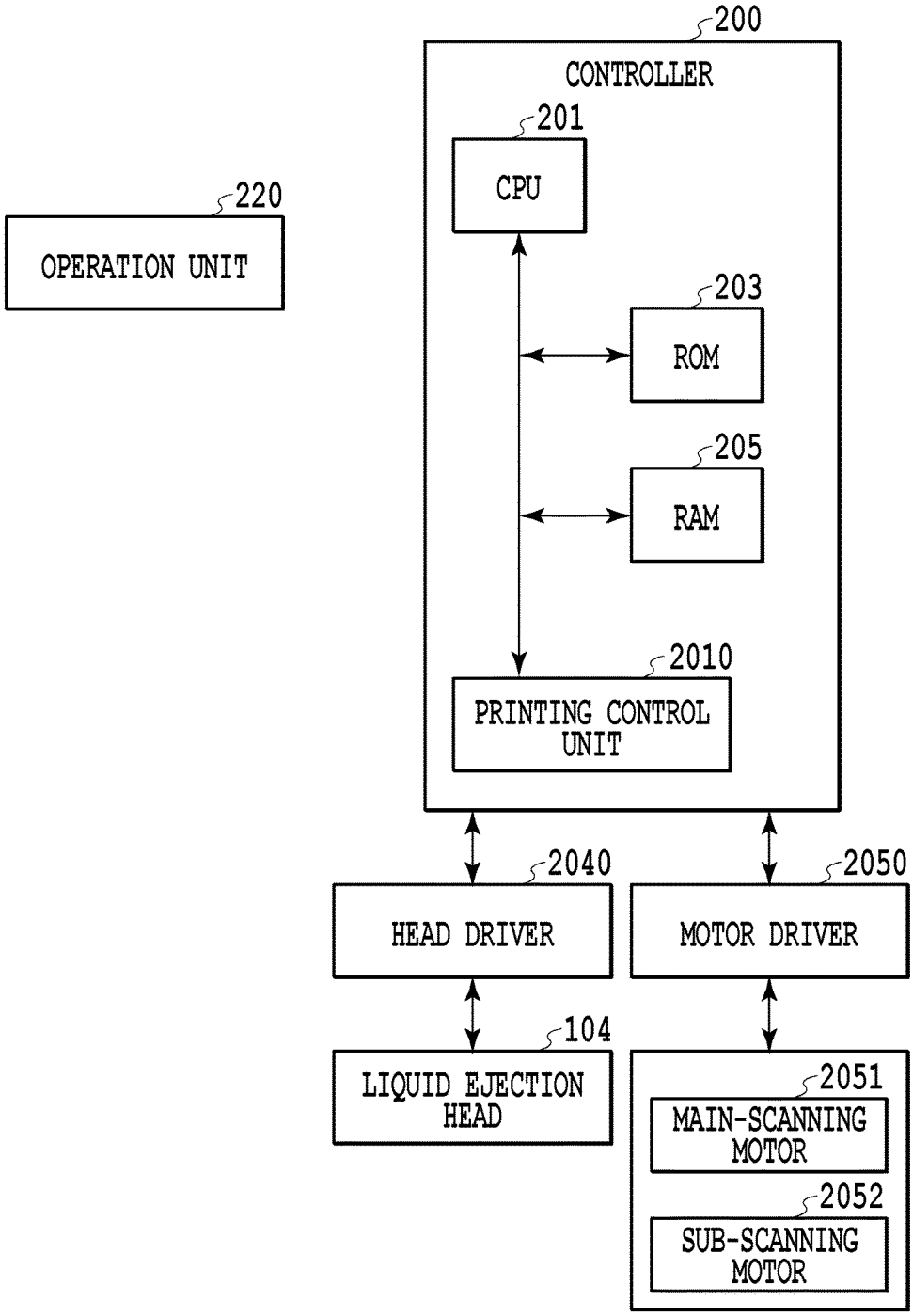
FIG. 2 is a block diagram illustrating a control system of a printing apparatus which performs inkjet printing by using the liquid ejection head illustrated in FIG. 1.

FIG. 2 is a block diagram illustrating a control system of a printing apparatus which performs inkjet printing by using the liquid ejection head illustrated in FIG. 1. In FIG. 2, a controller 200 is a main control unit, and includes: a CPU 201; a ROM 203 having a program, a required table, and other fixed data stored therein; a RAM 204 having an area for expanding print data and a working area provided therein; and a printing control unit 2010. The print data, other commands, a status signal, and the like are transmitted/received between a host device and the controller 200 via a non-illustrated interface (I/F).

An operation unit 220 is a group of switches for receiving an instruction input by an operator, and includes: a non-illustrated power supply switch; a switch for giving an instruction of printing start; a recovery switch for giving an instruction of suction recovery start; and the like. A head driver 2040 is a driver which drives an electrothermal conversion element of the liquid ejection head 104 according to print data or the like, and is capable of ejecting ink from the ejection port of the print head 104 through this driving. The liquid ejection head 104 includes an ejection port which ejects the ink of each of four colors, namely, cyan (C), magenta (M), yellow (Y), and black (K). A motor driver 2050 is a driver which drives: a main-scanning motor mounting the head cartridge 100 provided with the liquid ejection head 104, for moving the head cartridge 100 in a main-scanning direction; a sub-scanning motor for conveying a printing medium in a sub-scanning direction.

The control system described above detects a staying state of a bubble in a liquid chamber of the liquid ejection head on the basis of the resistance between electrodes arranged in the liquid chamber, and performs the ejection control corresponding to this detection, as described later in an embodiment of the present invention.

First Embodiment

Figure 3A:
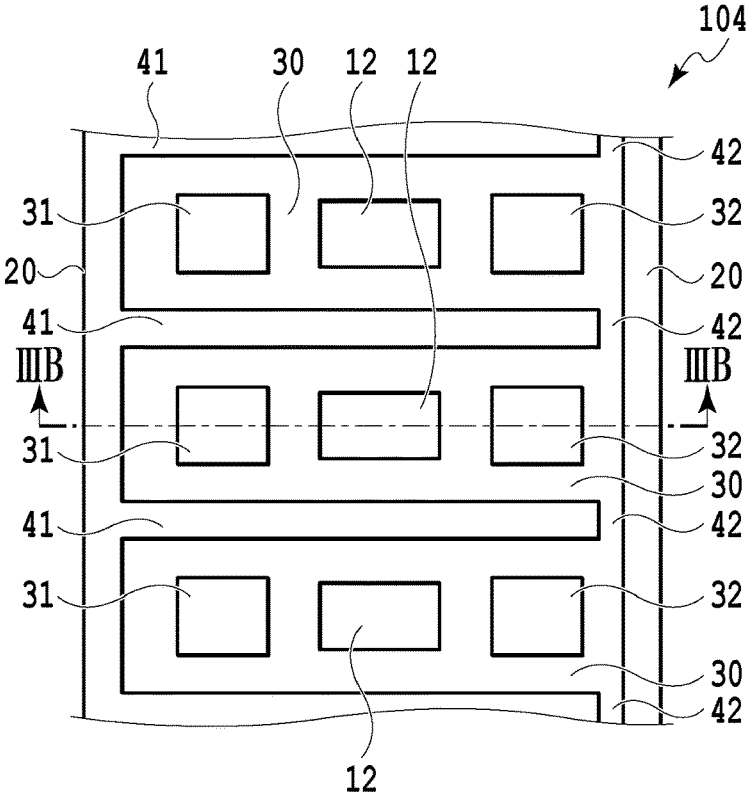
FIG. 3A and FIG. 3B illustrate a liquid ejection head according to a first embodiment of the present invention.
Figure 3B:
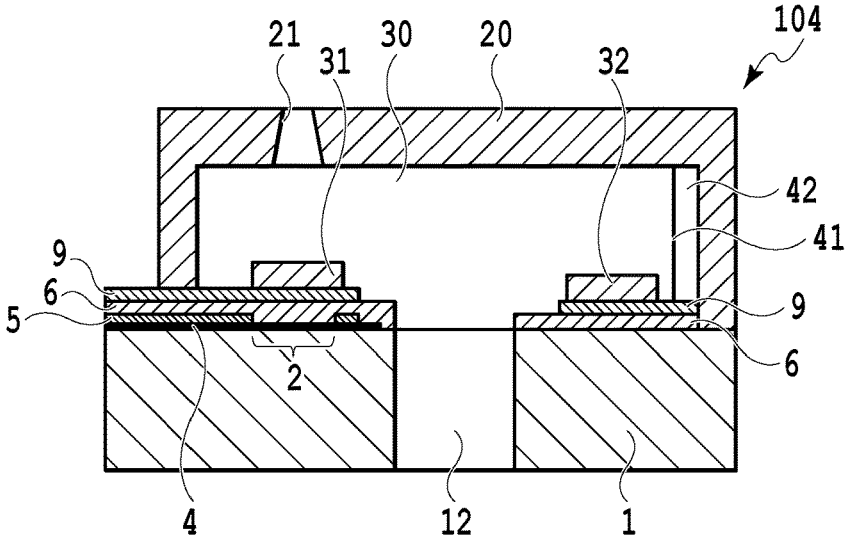

FIG. 3A and FIG. 3B illustrate a liquid ejection head according to a first embodiment of the present invention. FIG. 3A is a cross-sectional view illustrated except for the upper portion of a liquid chamber-forming member 20, and illustrates a structure corresponding to a part of the liquid ejection head of this embodiment, namely, a part (three) of a plurality of ejection ports arranged in line. Moreover, FIG. 3B is the cross-sectional view along a IIIB-IIIB line in FIG. 3A.

As illustrated in these views, the liquid ejection head 104 generally includes: a substrate 1; and the liquid chamber-forming member 20 provided on this substrate. The liquid chamber-forming member 20 is provided with an ejection port 21. Furthermore, a channel wall 41 is provided as a part of the liquid chamber-forming member, and the substrate 1 is provided with a heater 2 as an energy generation element corresponding to a liquid chamber 30. In addition, the substrate 1 is provided with a supply port 12 for supplying ink as liquid to a pressure chamber which applies a foaming pressure caused by the heater 2 for each liquid chamber 30. In each liquid chamber 30, a heater upper electrode 31 is provided above the heater 2, and furthermore, in the liquid chamber 30, a paired electrode 32 is provided at a position on a side opposite to a position where this electrode 31 is provided. Namely, the paired electrode 32 is provided on a side opposite to the heater upper electrode 31 with respect to the supply port 12. In the channel wall 41 which partitions the liquid chamber 30 and the adjacent liquid chamber 30, a void 42 is provided and liquid chambers adjacent via this void communicate with each other. This void 42 is provided so as to extend generally from the surface of the substrate 1 to the inner side surface of the upper portion of the liquid chamber-forming member 20.

The liquid chamber-forming member 20 can be formed of a resin, a metal, or an inorganic material. The examples of the resin can include a photosensitive resin such as an epoxy resin which cure by light cationic polymerization. The examples of the metal can include a SUS plate, and the examples of the inorganic material can include SiN, SiC, SiCN, or the like. In the example illustrated in FIG. 3A and FIG. 3B, the liquid chamber-forming member is formed of a resin. On the other hand, the substrate 1 is formed of silicon or the like.

In the substrate 1, the heater 2 is formed by a wiring layer 5 connected to a heating resistor layer 4 made of TaSiN or the like. Namely, a part of the wiring layer 5 formed on an upper part of the heating resistor layer 4 is removed to form a gap and the heating resistor layer 4 of the gap portion is exposed, thereby forming the heater 2. The wiring layer 5 is provided on the heating resistor layer 4, but in contrast, the heating resistor layer 4 may be provided on the wiring layer 5. Furthermore, in the undermost layer of the heater 2, there may be provided a heat storage layer composed of an SiO film or a BPSG film for preventing escaping of heat in contact with the substrate 1.

A protection layer 6 is provided on the heating resistor layer 4 and wiring layer 5, and functions as an insulating layer composed of an SiO film, an SiN film, or the like. An upper protection layer 31 is provided above the protection layer 6, and protects the heater 2 from chemical and physical effects associated with foaming of liquid, and in this embodiment, functions as the heater upper electrode 31 to which an electric potential is applied, in order to suppress kogation. The upper protection layer 31 includes a material to which an electric potential can be applied as the heater upper electrode, and the material which is stable particularly against heating is preferably used. Specifically, a noble metal such as Ir can be used. This upper protection layer 31 may be a single layer or even a plurality of layers stacked. In a case of stacking a plurality of layers, some of the layers may be insulating layers if an electric field formed by the heater upper electrode is not to be shielded. An electrode wiring 9 is for electrically connecting the upper protection layer 31 and an external electrode, and is formed by the use of an electrically conductive material. The electrode wiring 9 extends to an end portion of the liquid ejection head 104, and a tip thereof forms an external electrode (not illustrated) for electrically connecting to the outside. Alternatively, the electrode wiring 9 may be connected to the wiring layer 5 through a through-hole (not illustrated). The electrode wiring 9 and the upper protection layer 31 may be of the same member.

Although the paired electrode 32 is provided on the substrate 1, the electrode is not required to be in contact with the substrate 1 but may be provided via another layer with respect to the substrate 1. Alternatively, the paired electrode 32 may be provided in contact with the liquid chamber-forming member 20. The paired electrode 32 is paired with the heater upper electrode 31 and is used for forming an electric field between these electrodes. With this electric field, a substance such as a colloidal particle, which becomes hardly soluble due to heating of ink, can be moved from a vicinity of the heater upper electrode 31 to the paired electrode 32 side, and thus the adhesion of a koge to the heater upper electrode 31 or the like can be suppressed. This paired electrode 32 can be formed of a noble metal such as Ir. The paired electrode 32 may have a single layer or even a plurality of layers stacked, and in a case of stacking a plurality of layers, some of the layers may form insulating layers if an electric field formed between the heater upper electrode and the paired electrode is not to be shielded. The outermost layer of the paired electrode 32 preferably includes a material which does not dissolve in liquid. Note that the heater upper electrode is not necessarily required to be present above the heater 2, but may be at a position in a vicinity of the heater 2 where the heater upper electrode exhibits an effect of keeping, by an electric field formed by the heater upper electrode, a colloidal particle and the like in ink away from the heater 2. In this specification, from this viewpoint, the heater upper electrode is referred to also as a "near-element electrode."

The electrode wiring 9 is for electrically connecting the paired electrode 32 and an external electrode, and is formed by the use of an electrically conductive material, as with the heater upper electrode 31 described above. The electrode wiring 9 extends to an end portion of the liquid ejection head 104, and the tip thereof serves as an external electrode (not illustrated) for electrically connecting to the outside. Alternatively, the electrode wiring 9 may be connected to the wiring layer 5 through a through-hole (not illustrated). The electrode wiring 9 and paired electrode 32 may be of the same member.

The supply port 12 in the substrate 1 can be formed by dry etching, wet etching by TMAH, KOH or the like, laser processing, and the like. Ink supplied via the supply port 12 from an ink tank foams by a thermal energy generated by the heater 2, and the ink is ejected from the ejection port 21 due to the foaming pressure. Note that the number of supply ports corresponding to one heater may be one or may be plural. In a case where the number of supply ports corresponding to one heater is an even number, the supply ports are preferably arranged so as to sandwich the energy generation element since the liquid is equally supplied.

Figure 4A:
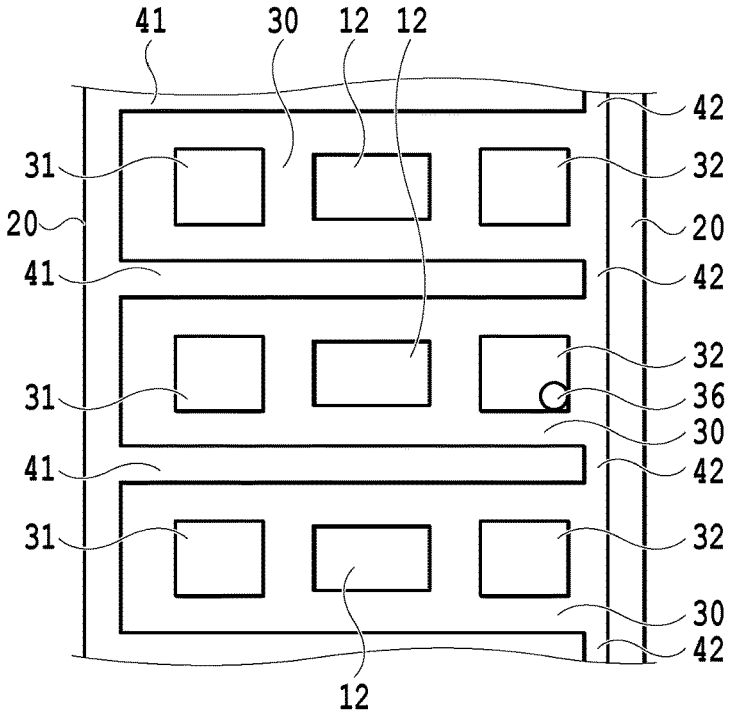
FIG. 4A and FIG. 4B illustrate an effect of a void formed in a channel wall in the liquid ejection head of the first embodiment of the present invention.
Figure 4B:
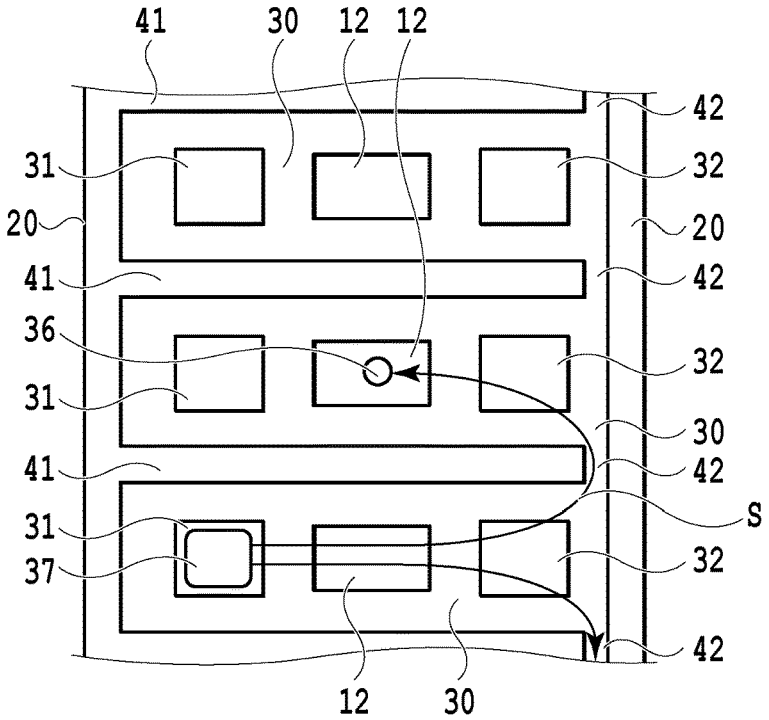

FIG. 4A and FIG. 4B illustrate the effect of the void 42 formed at the channel wall 41 in the liquid ejection head 104 of this embodiment, having the above-described configuration. In a state where the liquid chamber 30 of the liquid ejection head 104 of this embodiment described in FIG. 3A and FIG. 3B is filled with the ink containing a charged colloidal particle, a potential difference is applied between the heater upper electrode 31 and the paired electrode 32 to thereby form an electric field. Accordingly, the charged colloidal particle in the ink moves to the paired electrode 32 side from the surface of the heater upper electrode 31. In addition, the mutual driving timings of the heater 2 of the liquid chamber 30 and the heater 2 of the adjacent liquid chamber 30 are shifted from each other, and thus ejection is not performed simultaneously from the adjacent liquid chamber 30.

FIG. 4A illustrates a state where a bubble 36 adheres to the paired electrode 32, in the above state. Once ejection is performed in the adjacent liquid chamber 30 in this state, then foaming 37 generated at this time generates a flow S of ink in the direction of an arrow in this diagram, as illustrated in FIG. 4B. Namely, the flow of ink caused by the foaming 37 generated in the adjacent liquid chamber reaches the liquid chamber 30 where the paired electrode 32 to which the bubble 36 adheres is present, via the void 42 of the channel wall 41. Then, the bubble 36 is moved to the supply port 12 by the flow S, and the bubble 36 enters the inside of the supply port 12 by its buoyancy. Note that, in the diagram illustrated in FIG. 3B, although the supply port 12 is illustrated at a position on a lower side, the liquid ejection head of this embodiment is used with the ejection port 21 facing downward, as illustrated in FIG. 1. Namely, the view illustrated in FIG. 3B is used in an upside-down state (with the supply port 12 facing upward). In this state, the bubble 36 enters the supply port 12 by its buoyancy. As described above, in a configuration for moving, to the paired electrode side, a substance in ink which becomes hardly soluble due to heating by an electric field formed by the heater upper electrode and the paired electrode, the continued staying of the bubble 36 in the paired electrode 32 or in a vicinity thereof can be suppressed. As the result, the bubble does not stay and thus an effect of moving, to the paired electrode side, a substance in ink which becomes hardly soluble functions effectively, with the result that the adhesion of a koge onto the surface of the heater upper electrode can be reduced.

Note that the arrangement of the paired electrode 32 in the liquid chamber 30 is not limited to the above-described example. The paired electrode 32 may be at a distance at which an electric field formed between the heater upper electrode 31 and the paired electrode 32 exhibits an effect of reducing the concentration of charged particles in the ink in a vicinity of the heater 2 and at a position where a bubble present in a vicinity of the paired electrode 32 can be removed by the flow of ink from the void 42. In the configuration illustrated in FIG. 3B, the paired electrode 32 may be arranged, for example, on the inner surface side of the upper portion of the liquid chamber-forming member 20. In addition, the paired electrode is not necessarily required to be provided. As described in Japanese Patent Laid-Open No. 2009-51146, for example, an electric field may be formed by specifying a position of the liquid chamber-forming member 20 and connecting the position to the earth (grounding the position) and on the basis of a relationship with the heater upper electrode 31.

In the above-described example, the number of the paired electrodes 32 present in the same liquid chamber as the one heater upper electrode 31 is one, but is not limited thereto and may be plural. Alternatively, one paired electrode 32 may correspond to a plurality of heater upper electrodes 31. In addition, the void 42 is not required to be present at all the channel walls 41, and may be present at, for example, every other channel wall 41. Namely, the void 42 may be formed at at least one of two channel walls corresponding to one liquid chamber.

The paired electrode 32 may be arranged in the inside of the void 42 which is narrower than the liquid chamber 30. More specifically, at least a part of the paired electrode 32 may be arranged in the area where the void 42 of the upper part of the substrate 1 is provided. In other words, at least a part of the paired electrode 32 may be arranged in a communicating portion of the adjacent liquid chamber 30. When the paired electrode 32 is provided at such a position, the speed of the ink flow from the adjacent liquid chamber via the void 42 becomes quicker in the inside of the void 42 than the liquid chamber 30. Therefore, a bubble moves easily. As a result, the staying of a bubble is reduced in the vicinity of the paired electrode.

Second Embodiment

Figure 5:
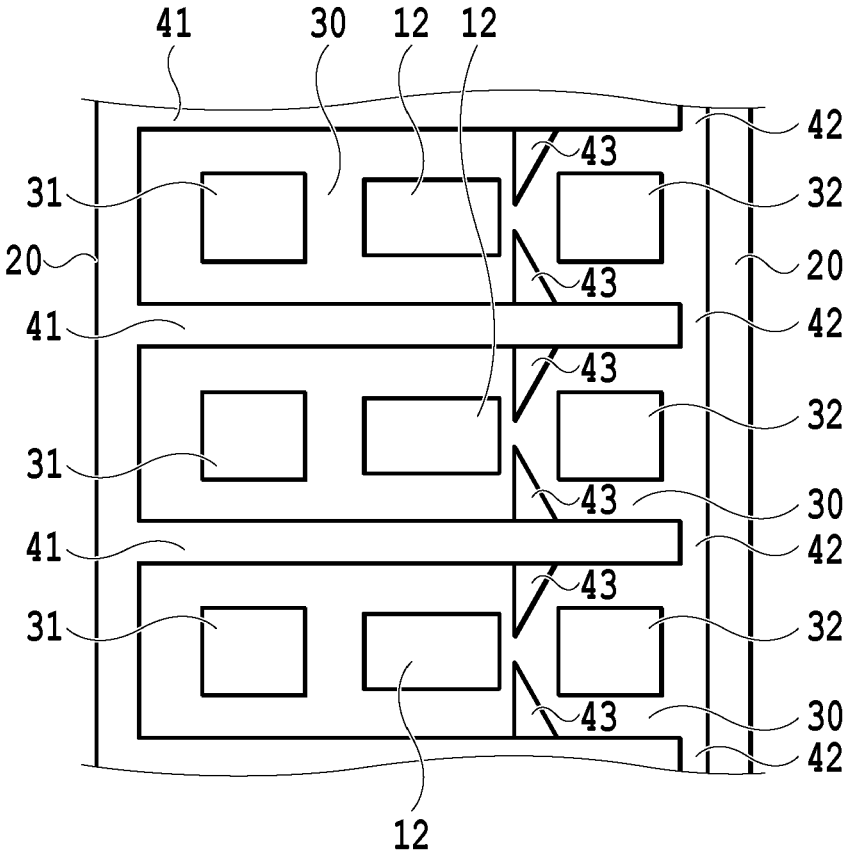
FIG. 5 illustrates the configuration of a liquid ejection head according to a second embodiment of the present invention.

FIG. 5 illustrates the configuration of the liquid ejection head 104 according to a second embodiment of the present invention, and is a diagram similar to FIG. 3A according to the first embodiment. Hereinafter, the explanation of the same components as those of the first embodiment will be omitted and components different from those of the first embodiment will be explained.

In the second embodiment, between the paired electrode 32 and the supply ports 12, there is provided a backflow prevention unit (backflow prevention member) 43 whose size is narrowed in the horizontal direction from the paired electrode 32 toward the supply port 12. Although the direction in which ink flows is reversed between the time of ejection and the time of refill, the backflow prevention unit 43 can suppress the reverse flow of the ink from the supply port 12 toward the paired electrode 32, thereby making a bubble difficult to flow backward to the paired electrode 32 side. Accordingly, the scorching to the surface of the heater upper electrode can be further reduced as compared with the first embodiment.

Third Embodiment

Figure 6A:
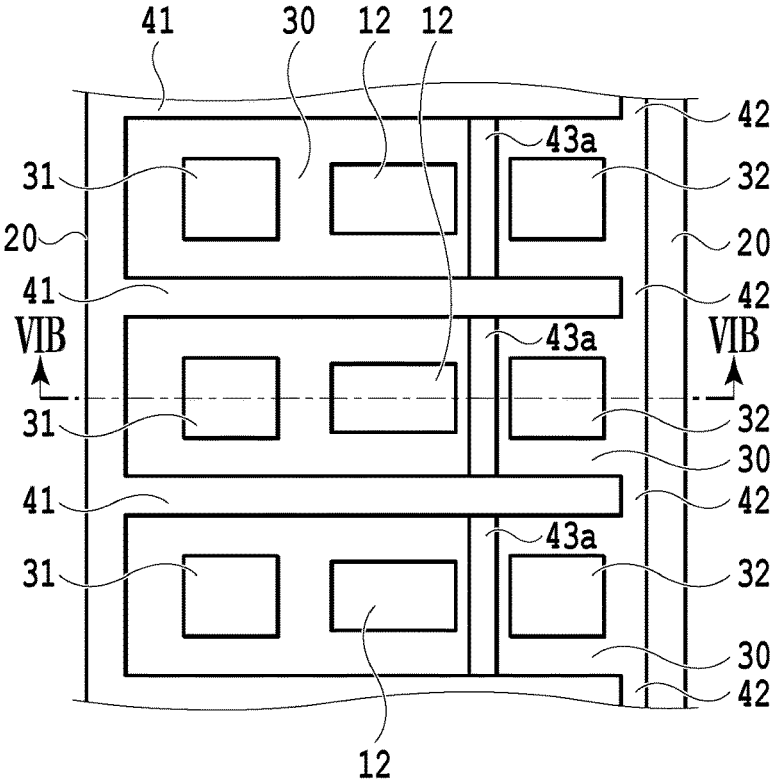
FIG. 6A and FIG. 6B are cross-sectional views for illustrating a liquid ejection head according to a third embodiment of the present invention.
Figure 6B:
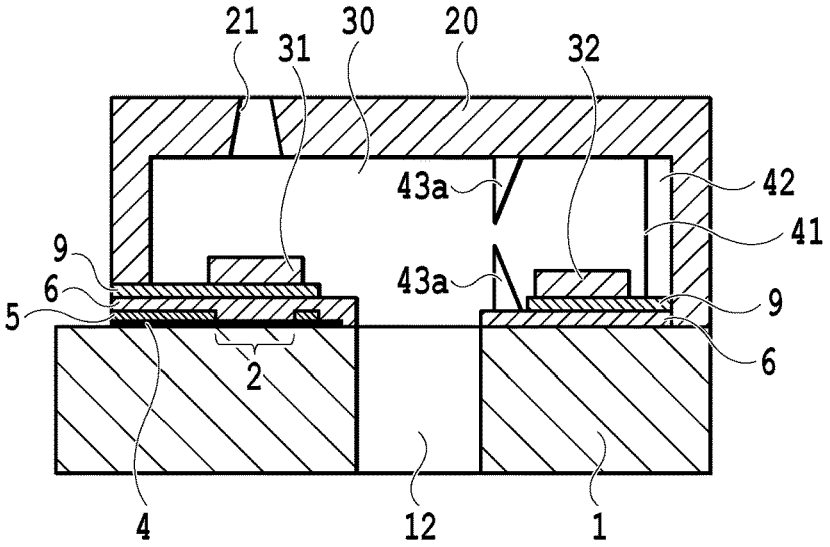

FIG. 6A and FIG. 6B are cross-sectional views for illustrating the liquid ejection head 104 according to a third embodiment of the present invention, and are diagrams similar to FIG. 3A and FIG. 3B. Hereinafter, the explanation of the same components as those of the second embodiment will be omitted and components different from those of the second embodiment will be explained.

In the second embodiment, there is provided a backflow prevention unit whose size is narrowed in the horizontal direction from the paired electrode 32 toward the supply port 12, whereas in the third embodiment, there is provided a backflow prevention unit 43*a* whose size is narrowed in the vertical direction from the paired electrode 32 toward the supply port 12. As with the second embodiment, the backflow prevention unit 43*a* can suppress the reverse flow of the ink from the supply port 12 toward the paired electrode 32, thereby making a bubble difficult to flow backward to the paired electrode 32 side.

Fourth Embodiment

Figure 7:
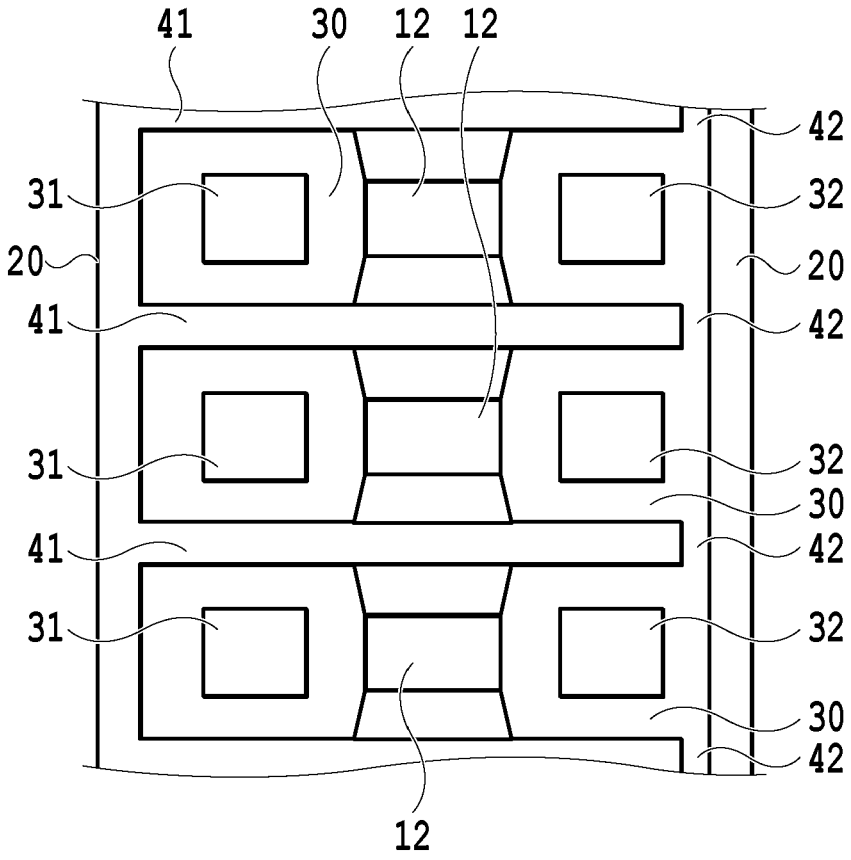
FIG. 7 illustrates a liquid ejection head according to a fourth embodiment of the present invention.

FIG. 7 illustrates the liquid ejection head 104 according to a fourth embodiment of the present invention. Hereinafter, the explanation of the same components as those of the first embodiment will be omitted and components different from those of the first embodiment will be explained.

In the first embodiment, the channel wall 41 has a uniform thickness in the horizontal direction in FIG. 7, whereas in the fourth embodiment, the thickness of the channel wall 41 is not uniform and as seen in the cross-section illustrated in FIG. 7, the channel wall 41 is provided with a convex portion which protrudes toward the supply port 12. Due to this convex portion, the length (distance between the channel walls 41) of a portion communicating with the supply port 12 in the liquid chambers 30 becomes shorter than the length of a portion in which the paired electrode 32 is provided, in the liquid chambers 30. Accordingly, a bubble which has been moved from the paired electrode 32 by the flow of ink via the void 42 becomes easy to move into the supply port 12 without staying in the liquid chamber 30 between the channel wall 41 and the supply port 12. In such a liquid ejection head 104, inhibition of a potential control effect by a bubble staying in the liquid chamber 30 can be suppressed and scorching to the surface of the heater upper electrode can be further reduced.

Fifth Embodiment

Figure 8:
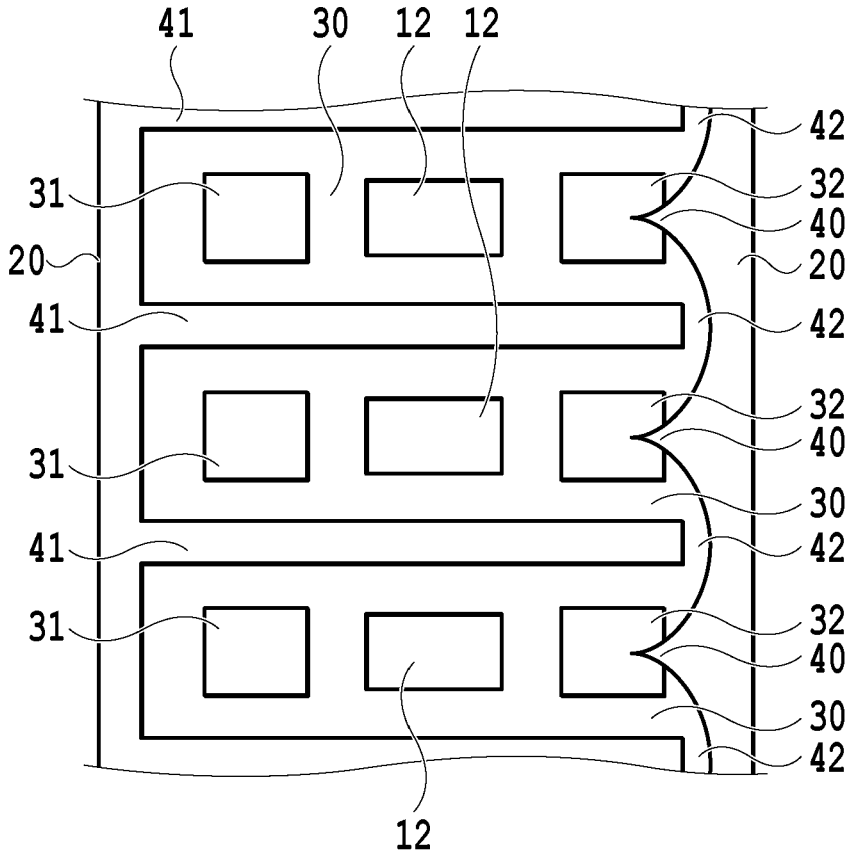
FIG. 8 illustrates a liquid ejection head according to a fifth embodiment of the present invention.

FIG. 8 illustrates the liquid ejection head 104 according to a fifth embodiment of the present invention. Hereinafter, the explanation of the same components as those of the first embodiment will be omitted and components different from those of the first embodiment will be explained.

In the first embodiment, among the liquid chamber-forming members 20 partitioning the liquid chamber, a member adjacent to the void 42 and extending in the arrangement direction of the paired electrode 32 has a uniform thickness. In contrast, in this embodiment, a partition 40 serving as a convex portion toward the paired electrode 32 is formed as a part of the liquid chamber-forming member 20, for each liquid chamber 30. Since the liquid chamber 30 between the void 42 and the paired electrode 32 is partitioned by the partition 40 in this way, the adjacent cavities 42 do not directly connect to each other in terms of channel. Accordingly, most of the flow of ink via the void 42 from the adjacent liquid chamber 30 does not go directly toward the void 42 on the opposite side, but passes through the liquid chamber 30 of a section in which the paired electrode 32 and the supply port 12 are present. As the result, a bubble in a vicinity of the paired electrode 32 can be easily moved to the supply port 12. In this embodiment, the shape of the partition 40 is rounded in a concave shape. Therefore, the flow of liquid via the void 42 from the adjacent liquid chamber 30 can flow without losing the strength thereof and also so as not to cause stagnation in the flow, and thus a bubble can be more easily moved.

In the positional and size-wise relationships between the partition 40 and the paired electrode 32, preferably, the area of the partition 40 on the paired electrode 32 is made as small as possible, or a gap is formed between the paired electrode 32 and the partition 40.

Sixth Embodiment

A sixth embodiment of the present invention relates to a configuration for controlling ejection from an ejection port corresponding to the liquid chamber 30 in accordance with staying of a bubble in the liquid chamber. Since the electric conductivity of a bubble is relatively lower than that of liquid such as ink, the resistance between the heater upper electrode 31 and the paired electrode 32 increases in a case where a bubble stays in a vicinity of the paired electrode as compared with a case where it does not stay.

In this embodiment, an electric-current measurement circuit is provided in an external electrode connected to the wiring layer of each heater upper electrode 31, and the degree of staying and the degree of removal of the bubble 36 between the heater upper electrode 31 and the paired electrode 32 are measured through a change in a resistance to be measured. Accordingly, as to the liquid chamber 30 in which staying of the bubble 36 is detected, the control is performed so as not to allow ejection from the ejection port of this liquid chamber 30, but so as to allow ejection from the ejection port of the adjacent liquid chamber 30. Specifically, the ejection from the adjacent ejection port is repeated until the above-described resistance value becomes equal to or less than a predetermined threshold at which it can be assumed that a bubble has been removed from the liquid chamber by the measurement of the above-described resistance value. Note that detection of the staying of a bubble in each of the plurality of consecutive liquid chambers 30 and ejection not from an ejection port of a liquid chamber but from an ejection port of a liquid chamber adjacent to the liquid chamber are performed sequentially from an end ejection port of an ejection port array. Furthermore, the electric-current measurement circuit may be provided in the wiring layer of the heater upper electrode 31 to measure a change in resistance, or an electric-current measurement unit may be provided in the wiring layer of the paired electrode 32 or in an external electrode connected to the wiring layer of the paired electrode 32 to measure a change in resistance.

A bubble staying in the liquid chamber 30 becomes unlikely to inhibit the electric-potential control effect, by control of the liquid ejection head 104 as described above.

Note that, although a bubble is detected via a change in resistance in the sixth embodiment, a bubble may be detected by optically determining the presence or absence of a bubble through the liquid chamber-forming member 20 from the outside of the liquid ejection head 104. Alternatively, a bubble may be detected by measurement of the speed of a liquid ejected to the outside of the liquid ejection head 104 through the supply port 12 and by utilization of a decrease in the speed of the ejected liquid resulting from a deterioration of the ejection efficiency due to staying of a bubble.

Seventh Embodiment

Figure 9:
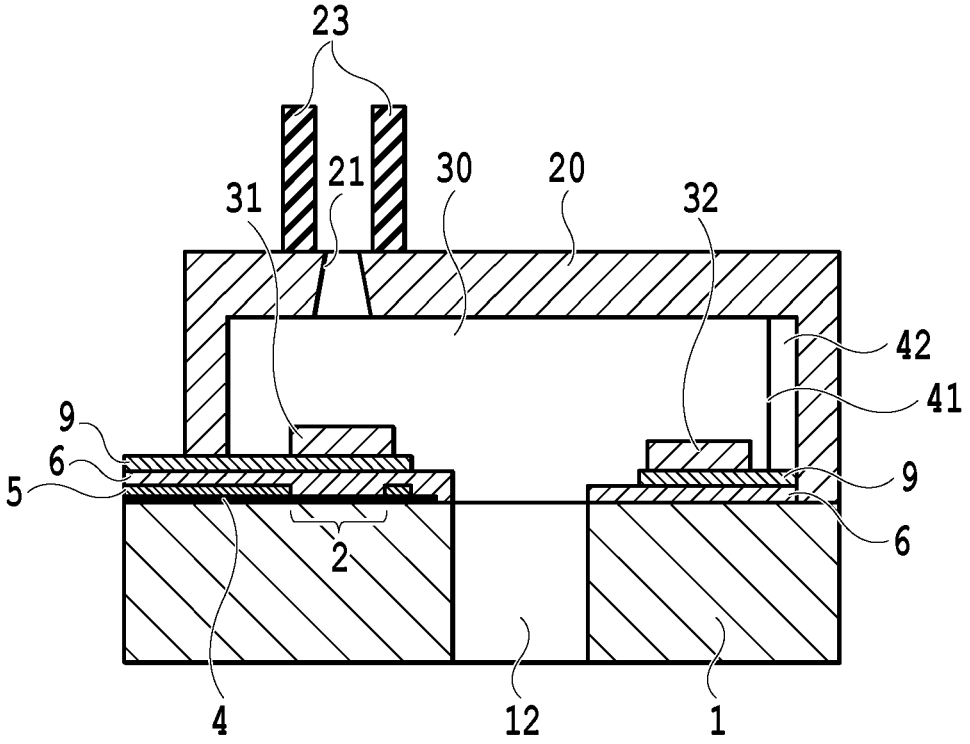
FIG. 9 illustrates a liquid ejection head according to a seventh embodiment of the present invention.

FIG. 9 illustrates the liquid ejection head 104 according to a seventh embodiment of the present invention. Hereinafter, the explanation of the same components as those of the sixth embodiment will be omitted and components different from those of the sixth embodiment will be explained.

In the sixth embodiment, the driving timings between the heater 2 of the liquid chamber 30 and the heater 2 of the adjacent liquid chamber 30 are shifted from each other to thereby not allow simultaneous ejection from the ejection port 21 of the adjacent liquid chamber 30, and a bubble is removed by utilization of a flow of ink which is generated via the void 42 at the time of ejection of the adjacent liquid chamber 30. In contrast, in the seventh embodiment, as illustrated in FIG. 9, a hollow tube 23 is applied to the ejection port 21 of the liquid chamber 30 by the use of a non-illustrated mechanism, this tube is scanned in an ejection port array direction, and thus suction is performed by the use of a suction mechanism (not illustrated) sequentially connected to the tube for each ejection port. Accordingly, the suction generates the flow of ink from the adjacent liquid chamber via the void 42, and a bubble is guided into the supply port 12 by the flow. At this time, in a case where the presence of a bubble in the adjacent liquid chamber is detected by the bubble detection mechanism described in the above-described sixth embodiment, suction is not performed. This is because a bubble in the adjacent liquid chamber might move to a liquid chamber to be sucked by the flow of ink generated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-225312, filed Nov. 18, 2016, which is hereby incorporated by reference herein in its entirety.

What is claimed is:

1. A liquid ejection head comprising:

a wall member for partitioning a first liquid chamber and a second liquid chamber adjacent to each other and forming the first liquid chamber and the second liquid chamber, the wall member having formed therein a void for communicating between the first liquid chamber and the second liquid chamber;

a first energy generation element which is provided in the first liquid chamber and foams liquid in order to eject the liquid;

a second energy generation element which is provided in the second liquid chamber and foams liquid in order to eject the liquid;

a first electrode which is provided in the first liquid chamber and is arranged in a vicinity of the first energy generation element;

a second electrode for forming, between the first electrode and the second electrode, an electric field in liquid inside the first liquid chamber; and a supply port which supplies liquid to the first energy generation element, wherein the wall member includes a channel wall defining a channel through which the second liquid chamber, the void, and the supply port communicate, in this order, with each other via liquid, and the second electrode is arranged between the second liquid chamber and the supply port in the channel.

2. The liquid ejection head according to claim 1, wherein the second electrode and the supply port are provided in the first liquid chamber, and in the channel, the second electrode is arranged between the void and the supply port.

3. The liquid ejection head according to claim 2, wherein in the channel, the second energy generation element, the void, the second electrode, and the supply port communicate, in this order, with each other via liquid.

4. The liquid ejection head according to claim 2, wherein the wall member includes a convex portion protruding toward the supply port.

5. The liquid ejection head according to claim 2, further comprising a partition adjacent to the void, the partition extending in a direction along which the first liquid chamber and the second liquid chamber are adjacent to each other and becoming a convex portion from the wall member toward the second electrode.

6. The liquid ejection head according to claim 1, wherein a protection layer provided above the first energy generation element serves as the first electrode.

7. The liquid ejection head according to claim 1, further comprising, between the first electrode and the second electrode, a backflow prevention member for preventing a flow of liquid in a direction from the first electrode toward the second electrode.

8. The liquid ejection head according to claim 7, wherein the backflow prevention member forms a portion in which a size of the first liquid chamber from the second electrode toward the first electrode is narrowed.

9. The liquid ejection head according to claim 1, wherein at least a part of the second electrode is provided in a communicating portion of the first liquid chamber and the second liquid chamber corresponding to the void, and the supply port is provided in the first liquid chamber.

10. A liquid ejection apparatus comprising:

a liquid ejection head including a wall member for partitioning a first liquid chamber and a second liquid chamber adjacent to each other and forming the first liquid chamber and the second liquid chamber, the wall member having formed therein a void for communicating between the first liquid chamber and the second liquid chamber; a first energy generation element which is provided in the first liquid chamber and foams liquid in order to eject the liquid; a second energy generation element which is provided in the second liquid chamber and foams liquid in order to eject the liquid; a first electrode which is provided in the first liquid chamber and is arranged in a vicinity of the first energy generation element; a second electrode which is provided in the first liquid chamber and is for forming, between the first electrode and the second electrode, an electric field in liquid inside the first liquid chamber; and a supply port which supplies liquid to the first energy generation element, wherein the wall member includes a channel wall defining a channel through which the second liquid chamber, the void, and the supply port communicate, in this order, with each other via liquid, and the second electrode is arranged between the second liquid chamber and the supply port in the channel;

a detection unit configured to detect a bubble between the first electrode and the second electrode in the first liquid chamber; and a generation unit configured to generate, in a case where the detection unit detects a bubble, a flow of liquid moving toward the first liquid chamber via the void from the second liquid chamber.

11. The liquid ejection apparatus according to claim 10, wherein the detection unit detects a bubble by measuring a resistance value between the first electrode and the second electrode.

12. The liquid ejection apparatus according to claim 10, wherein the detection unit optically detects a bubble between the first electrode and the second electrode.

13. The liquid ejection apparatus according to claim 10, wherein the generation unit generates the flow of liquid not by ejecting liquid from an ejection port corresponding to the first liquid chamber but by ejecting liquid from an ejection port corresponding to the second liquid chamber.

14. The liquid ejection apparatus according to claim 10, wherein the generation unit generates the flow of liquid by sucking liquid via an ejection port corresponding to the first liquid chamber.

15. A control method of a liquid ejection head, the liquid ejection head including a wall member for partitioning a first liquid chamber and a second liquid chamber adjacent to each other and forming the first liquid chamber and the second liquid chamber, the wall member having formed therein a void for communicating between the first liquid chamber and the second liquid chamber; a first energy generation element which is provided in the first liquid chamber and foams liquid in order to eject the liquid; a second energy generation element which is provided in the second liquid chamber and foams liquid in order to eject the liquid; a first electrode which is provided in the first liquid chamber and is arranged in a vicinity of the first energy generation element; a second electrode for forming, between the first electrode and the second electrode, an electric field in liquid inside the first liquid chamber; and a supply port which supplies liquid to the first energy generation element, wherein the wall member includes a channel wall defining a channel through which the second liquid chamber, the void, and the supply port communicate, in this order, with each other via liquid, and the second electrode is arranged between the second liquid chamber and the supply port in the channel, the method comprising the step of:

generating a flow of liquid which moves toward the supply port past the second electrode via the void from the second liquid chamber.

16. The control method of a liquid ejection head according to claim 15, wherein the step of generating the flow of liquid includes ejecting liquid from an ejection port corresponding to the second liquid chamber without ejecting liquid from an ejection port corresponding to the first liquid chamber.

17. The control method of a liquid ejection head according to claim 15, wherein the step of generating the flow of liquid includes sucking liquid via an ejection port corresponding to the first liquid chamber.

18. The control method of a liquid ejection head according to claim 15, wherein the second electrode is provided in the first liquid chamber, the method further comprises a detection step of detecting a bubble between the first electrode and the second electrode in the first liquid chamber, and in a case where a bubble is detected in the detection step, the step of generating the flow of liquid is performed.

* * * * *